US006313716B1

(12) United States Patent
Apostolos

(10) Patent No.: US 6,313,716 B1
(45) Date of Patent: Nov. 6, 2001

(54) SLOW WAVE MEANDER LINE HAVING SECTIONS OF ALTERNATING IMPEDANCE RELATIVE TO A CONDUCTIVE PLATE

(75) Inventor: John T. Apostolos, Merrimack, NH (US)

(73) Assignee: Lockheed Martin Corporation, Nashua, NH (US)

( * ) Notice: Subject to any disclaimer, the term of this patent is extended or adjusted under 35 U.S.C. 154(b) by 0 days.

(21) Appl. No.: 08/389,868

(22) Filed: Feb. 17, 1995

(51) Int. Cl.[7] ..... H01P 1/18
(52) U.S. Cl. ..... 333/162; 333/164
(58) Field of Search ..... 333/161, 162, 333/164

(56) References Cited

U.S. PATENT DOCUMENTS 3,899,757 * 8/1975 Nakagami et al. ..... 333/161 X
4,729,510 * 3/1988 Landis ..... 333/162

FOREIGN PATENT DOCUMENTS

7201 * 1/1985 (JP) ..... 333/161
4096401 * 3/1992 (JP) ..... 333/161

* cited by examiner

*Primary Examiner*—Benny Lee
(74) *Attorney, Agent, or Firm*—David W. Gomes

(57) ABSTRACT

A meander line includes a electrically conductive plate, a plurality of transmission line sections supported with respect to the conductive plate, wherein the plurality of sections includes a first section located relatively closer and parallel to the conductive plate to have a relatively lower characteristic impedance with the conductive plate and a second section located parallel to and at a relatively greater distance from the conductive plate than the first section to have a relatively higher characteristic impedance with the conductive plate, and connector means for interconnecting the first and second sections and maintaining an impedance mismatch therebetween.

7 Claims, 2 Drawing Sheets

$$Z_0 = \sqrt{Z_1 Z_2}$$

PROPAGATION CONSTANT $\beta = \beta_0/2 \sqrt{\frac{Z_1}{Z_2}}$

WHERE $\beta_0 = 2\pi/\lambda_0$

SLOW WAVE MEANDER LINE HAVING SECTIONS OF ALTERNATING IMPEDANCE RELATIVE TO A CONDUCTIVE PLATE

BACKGROUND OF THE INVENTION

1. Field of the Invention

The present invention generally relates to meander lines, and particularly to such meander lines which exhibit slow wave propagation characteristics.

2. Statement of the Prior Art

It is known to use delay lines for the purposes of time delay and phase adjustment of r.f. and h.f. signals. One particular embodiment of delay line is a meander line in which a single transmission line follows a serpentine route across the width of an area as it proceeds along the length of that area. One particular adaptation of delay lines is known as a slow wave line because wave propagation therethrough is slower than it would be for a simple delay line of the same length.

SUMMARY OF THE INVENTION

Accordingly, it is a object of the present invention to provide a meander line delay line.

It is a further object of the present invention to provide such a meander line which exhibits slow wave propagation characteristics.

It is yet a further object of the present invention to provide such a slow wave meander line which has a tunable length.

The present invention provides a meander line, comprising: a electrically conductive plate; a plurality of transmission line sections supported with respect to the conductive plate, wherein the plurality of sections includes a first section located relatively closer and parallel to the conductive plate to have a relatively lower characteristic impedance with the conductive plate and a second section located parallel to and at a relatively greater distance from the conductive plate than the first section to have a relatively higher characteristic impedance with the conductive plate; and connector means for interconnecting the first and second sections and maintaining an impedance mismatch therebetween.

BRIEF DESCRIPTION OF THE DRAWINGS

The present invention is illustratively described in reference to the appended drawings in which.

DETAILED DESCRIPTION OF THE DRAWINGS

Figure 1:
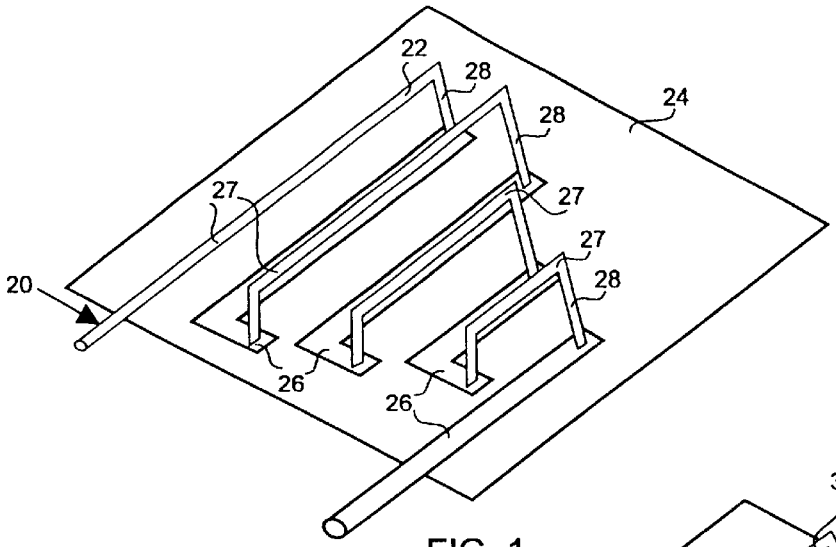
FIG. 1 is a representational perspective view of a slow wave meander line constructed in accordance with one embodiment of the present invention.

FIG. 1 shows a representative perspective view a meander line 20 constructed in accordance with one embodiment of the present invention. Meander line 20 is in the form of a folded transmission line 22 mounted on a plate 24. Transmission line 22 may be constructed from a folded microstrip line which includes alternating sections 26,27 thereof which are mounted close to and separated from the plate 24, respectively. This variation in height from plate 24 of alternating sections 26,27 gives those sections alternating impedance levels with respect to plate 24.

Sections 26, which are located close to plate 24 to form a lower characteristic impedance, are shown as dotted lines which are not intended to represent phantom lines. Sections 26 are electrically insulated from plate 24 by any suitable means such as an insulating material positioned therebetween. Sections 27 are located a predetermined distance from plate 24, which predetermined distance determines the characteristic impedance of the transmission line section 27 in conjunction with the other physical characteristics of the line as well as the frequency of the signal being transmitted over the line.

Sections 26 and 27 are interconnected by folded sections 28 of the microstrip line which are mounted in an orthogonal direction with respect to plate 24. In this form, the transmission line 22 may be constructed as a single continuous folded microstrip line.

Figure 2:
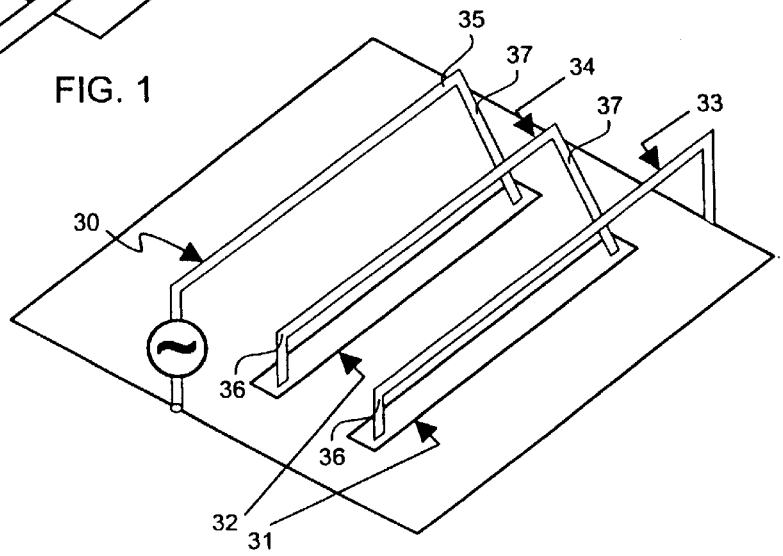
FIG. 2 is a perspective view of a meander line constructed in accordance with another embodiment of the present invention.

FIG. 2 is a representational view of another version of the meander line 30, which includes a plurality of lower impedance sections 31, 32 and a plurality of relatively higher impedance sections 33, 34, 35. The lower impedance sections 31,32 are located parallel to adjacent higher impedance sections 33,34, respectively. Sequential lower and higher impedance sections are interconnected by substantially orthogonal sections 36 and by diagonal sections 37. This arrangement enables the construction of solid state shorting switches between the adjacent lower and higher impedance sections to provide for electronically switchable control of the length of the meander line 30. All of the meander line sections 31–35 are of approximately equal length.

Figure 3:
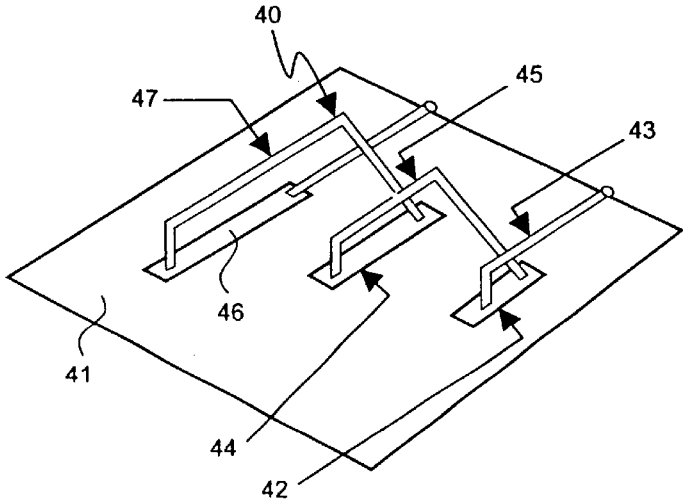
FIG. 3 is a perspective view of a meander line constructed in accordance with yet another embodiment of the present invention.

FIG. 3 shows a representational, perspective view of yet another meander line 40 including lower impedance sections 42,44,46 and higher impedance sections 43,45,47 mounted on a plate 41. Each of the higher impedance sections includes a parallel lower impedance section located parallel thereto for locating shorting switches therebetween. The logarithmic difference in lengths between sequential parallel sections allows the logarithmic switching of the meander line length.

Figure 4:
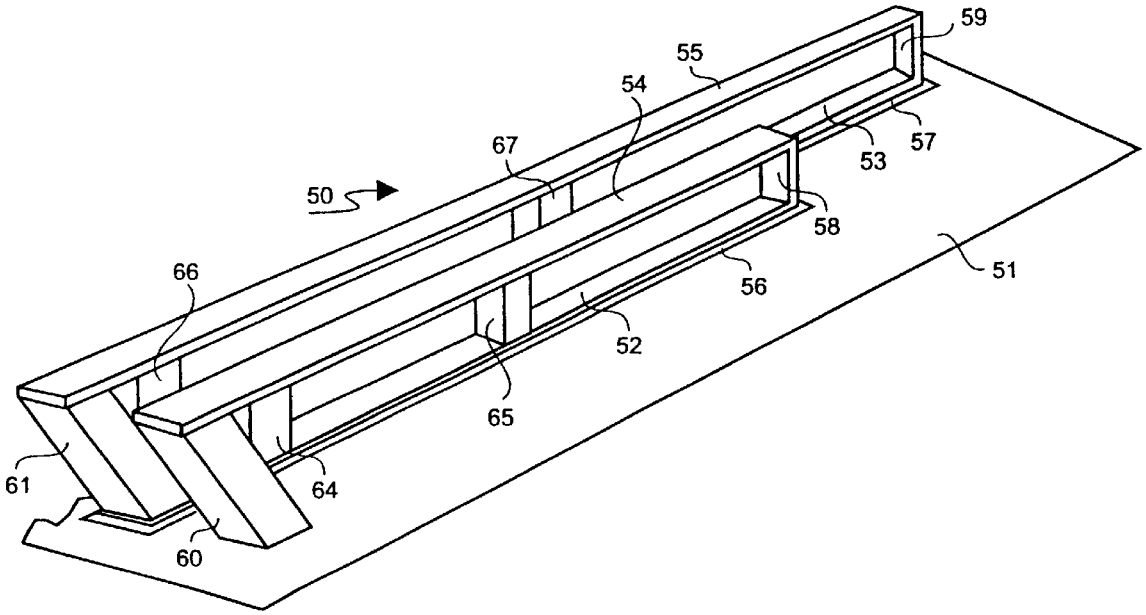
FIG. 4 is a perspective view of a portion of the meander line of FIG. 3

FIG. 4 shows a partial, perspective view of a meander line 50 constructed very similarly to the meander line 40 of FIG. 3. Meander line 50 is mounted on an electrically conductive plate 51 and includes a plurality of lower impedance sections 52, 53 and a plurality of higher impedance sections 54,55. Lower impedance sections 52,53 are electrically insulated from plate 51 by TEFLON pads 56,57, respectively, but are located in close proximity to plate 51 to produce a relatively lower characteristic impedance. Higher impedance sections 54,55 are characterized by a larger separation from plate 51 than that of sections 52,53. Sections 52–55 are constructed from microstrip line and are interconnected, at least at one end by portions 58,59 of the same microstrip line, which portions 58,59 are oriented in an orthogonal position with respect to plate 51. Those lower and higher impedance sections 52,54 and 53,55, which are respectively connected by portions 58,59, are also located parallel to each other and in vertical alignment with respect to plate 51. The purpose of this is to allow portions of the lines to be shorted together as described below.

The other ends of sections 52,55 are connected via diagonal sections 60,61. Diagonal section 60 may be used to connect higher impedance section 54 to a terminal or the like. Diagonal section 61 connects the lower impedance section 52 to the higher impedance section 55.

In the manner described, the sections are all serially interconnected with higher and lower impedances alternating in the sequence 54, 52, 55, 53. This unmatched or mismatched switching of impedance along the meander line, as shown in most of the figures, gives the meander line a 'slow wave' propagation characteristic. That is the propagation time through the meander line is greater that it would be if the line were constructed with only a single impedance or without the impedance mismatches. Any impedance mismatch due to the orthogonal sections 58, 59 or the diagonal sections 60,61 will contribute to this slow wave affect.

The meander line 50 includes an additional feature which was only alluded to in the previous figures. That is the inclusion of a plurality of controllable shorting switches 64,65,66,67. Switches 64,66 are located near the feed point of parallel interconnected sections so that such pairs of sections may be completely shorted out. Switches 65,67 are located approximately half way along interconnected sections to allow the shorting out of approximately half of the transmission line distance of such interconnected sections. Such switches may take any suitable form such as mechanical switches or electronically controllable switches such as pin diodes.

Figure 5:
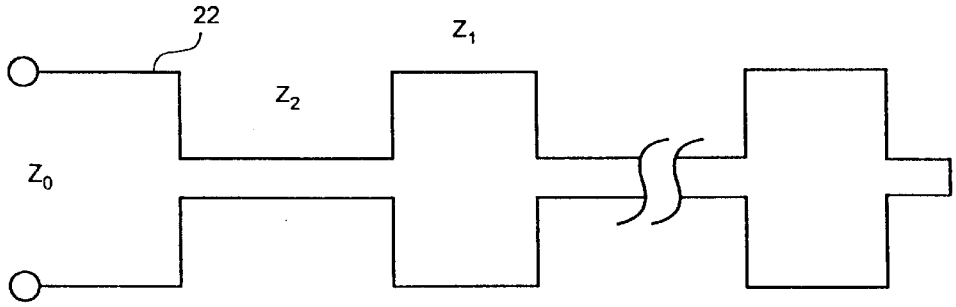
FIG. 5 is a diagram of the electrical image of the element coupler of FIG. 2.

FIG. 5 shows the electrical image of the slow wave, meander line 22 having alternating lower and higher impedance sections. The equations below FIG. 5 describe the variation of the propagation constant $\beta$ in relation to the line impedances when the ratio of the higher impedance to the lower impedance is greater than five to one. Generally, the greater the difference is between the lower and higher impedance values, the lower the propagation constant is for the line. These results hold for constant length sections where the lengths are all much less than one-quarter wavelength. The log-periodic version also tends to follow these results. In FIG. 5, $Z_0$ represents impedance of meander line 22, and $Z_1$ and $Z_2$ represent the impedances of respective portions of line 22. Likewise, $\beta$ represents the propagation constant of meander line 22, and $\beta_0$ represents the propagation constant of a similar transmission line having constant impedance.

CONCLUSION

The present invention combines the benefits of a meander line and a slow wave device to provide a geometrically efficient and readily tunable delay line.

The embodiments described above are intended to be taken in an illustrative and not a limiting sense. Various modifications and changes may be made to the above embodiments by persons skilled in the art without departing from the scope of the present invention as defined in the appended claims.

What is claimed is:

1. A meander line, comprising:

an electrically conductive plate;

a transmission line having a plurality of first and second sections supported with respect to the conductive plate, wherein each first section is located parallel with and relatively closer to the conductive plate than each second section to have a relatively lower characteristic impedance with the conductive plate than each second section, each second section is located parallel with and at a relatively greater distance from the conductive plate than each first section to have a relatively higher characteristic impedance with the conductive plate than each first section, and each second section is further located parallel and adjacent to a separate first section to form a section pair with that adjacent, parallel first section;

connector means for serially and alternately interconnecting the first and second sections and maintaining an impedance mismatch therebetween and for serially connecting the first and second sections of each section pair; and switch means for selectably shorting together the sections of each separate section pair, wherein the switch means are located at predetermined positions between the first and second sections of each separate section pair.

2. The meander line of claim 1, wherein the connector means is oriented approximately orthogonal to the conductive plate.

3. The meander line of claim 1, wherein the meander line has a characteristic length which is selectably changeable with the switch means.

4. The meander line of claim 1, wherein the separate section pairs have logrithmically varying lengths.

5. The meander line of claim 1, wherein the separate section pairs have equal lengths.

6. A meander line, comprising:

an electrically conductive plate;

a transmission line having a multiplicity of first and second sections supported with respect to the conductive plate, wherein each first section is located parallel with and relatively closer to the conductive plate than each second section to have a relatively lower characteristic impedance with the conductive plate than each second section, each second section is located parallel with and at a relatively greater distance from the conductive plate than each first section to have a relatively higher characteristic impedance with the conductive plate than each first section, and each second section is further located parallel and adjacent to a separate first section to form a multiplicity of section pairs; and connector means for serially and alternately interconnecting the first and second sections and maintaining an impedance mismatch therebetween and for serially connecting the first and second sections of each section pair, wherein the separate section pairs have logrithmically varying lengths.

7. The meander line of claim 6, further comprising switch means for selectably shorting together the sections of each separate section pair, wherein the switch means are located at predetermined positions between the first and second sections of each separate section pair.

* * * * *